United States Patent [19]

Bankier et al.

[11] Patent Number: 4,497,694

[45] Date of Patent: Feb. 5, 1985

[54] METHOD OF MANUFACTURING ABRASIVE ARTICLES

[75] Inventors: Jack D. Bankier, Northbrook; Dennis A. Gross, Lake Forest, both of Ill.

[73] Assignee: Barristo, Ltd., Chicago, Ill.

[21] Appl. No.: 602,403

[22] Filed: Apr. 17, 1984

[51] Int. Cl.[3] ..... C25D 5/34; C25D 5/48; C25D 15/00

[52] U.S. Cl. ..... 204/16; 204/38 B; 204/38 E

[58] Field of Search ..... 204/16, 38 B, 38 E, 204/41

[56] References Cited

U.S. PATENT DOCUMENTS

| | | | |
|---|---|---|---|
| 3,377,264 | 4/1968 | Duke | 204/16 |
| 3,932,227 | 1/1976 | Rothenberg | 204/16 |
| 4,369,098 | 1/1983 | Van Roeyen | 204/16 |

*Primary Examiner*—Thomas Tufariello
*Attorney, Agent, or Firm*—Hill, Van Santen, Steadman & Simpson

[57] ABSTRACT

Abrasive articles, such as finger nail files, are made by stamping a metal sheet to form a blank with a header strip having a plurality of spaced fingers depending therefrom, coating the fingers with a slurry of abrasive granules and flowable plastics material adhesive, curing the coating to anchor the abrasive particles to the fingers, vacuum depositing a thin strike coating of copper or copper alloy over the cured resin coating and then electro depositing a coating of nickel over the vacuum deposited copper. The abrasive granules are preferably aluminum oxide, the resin carrier for the granules is preferably an epoxide thermosetting resin, and the metal coatings are controlled to form thin sheaths around the resin coating leaving the peaks of the abrasive granules exposed or only covered with very thin coatings which break off or wear away when subjected to friction. The cured, abrasive particle containing resin coating is sufficiently stable to resist deterioration during the vacuum coating operation which is carried out in several sequential stages initially releasing gases in the resin coating, then melting the copper, increasing the vacuum and temperature to vaporize the copper and then depositing the vapor on the fingers forming a sheath around the resin coating.

8 Claims, 4 Drawing Figures

METHOD OF MANUFACTURING ABRASIVE ARTICLES

FIELD OF THE INVENTION

This invention relates to the manufacture of abrasive articles, such as finger nail files. Specifically, the invention deals with a simplified method of making abrasive articles wherein a vacuum metalizing step replaces a plurality of heretofore required operations.

BACKGROUND OF THE INVENTION

Prior Art

The Harry P. Van Roeyen U.S. Pat. No. 4,397,325, issued Aug. 9, 1983 to Barristo Ltd. of Chicago, Ill. discloses and claims abrasive articles, such as finger nail files, having a base, such as a metal finger, coated with an abrasive particle containing resin which is covered with a crust of electro deposited metal. The abrasive particles, such as aluminium oxide grits, are thus firmly anchored to the base. The peaks of the particles either project above the coatings or are only covered with thin frangible coating portions which wear away or break off when the abrasive article is subjected to friction in use. These articles were made according to the method described and claimed in the Harry P. Van Roeyen U.S. Pat. No. 4,369,098 issued on Jan. 18, 1983 to Barristo Ltd. of Chicago, Ill. The method included an electroless plating step, an electro plating step for depositing a strike coating over the electroless coating, and one or more additional electro plating steps to deposit coatings over the strike coating. Intermediate washing, etching, rinsing, and the like steps were also required.

It would then be an improvement in this art to manufacture abrasive devices, such as finger nail files of the type disclosed and claimed in the Van Roeyen U.S. Pat. No. 4,397,325, by a process eliminating some of the steps of the Van Roeyen U.S. Pat. No. 4,369,098.

SUMMARY OF THE INVENTION

According to this invention, abrasive articles, such as files, particularly finger nail files, are made by coating a base, such as metal, particularly steel, with a slurry of abrasive granules and adhesive resin. The steel base is preferably stamped from a steel sheet into a plurality of finger nail file shaped fingers suspended from a header strip through narrow connecting nibs that are easily broken to separate the fingers from the header. The slurry is preferably a mixture of aluminum oxide sharp pointed granules or grits of selected size and a thermosetting, preferably epoxy, resin. The coating can be applied by dipping, brushing, or, preferably by spraying. The coating is heat cured and the resin settles or shrinks down to expose peaks of the abrasive particles. Then, the cured resin coated articles are suspended in a vacuum metallizing apparatus containing a crucible of strike metal, preferably copper or copper alloy powder. The apparatus is initially evacuated to degasify any air or gases trapped in the coating, is heated, and further evacuated to vaporize the metal powder forming a strike coating as a sheath around the resin coating. After the vacuum metallizing treatment, the articles are electro plated, preferably with nickel, forming a thin plating layer over and around the strike coating. The nibs are then broken to separate the fingers and the nib ends of the fingers are covered with a plastic handle. The vacuum metallizing step eliminates many of the steps in the aforesaid Van Roeyen process including stack curing, cleaning, rinsing, accelerator bath treatment, and electroless plating.

It is then an object of this invention to simplify the method of making abrasive particle of the type covered in the Van Roeyen U.S. Pat. No. 4,397,325 issued Aug. 9, 1983.

Another object of this invention is to provide a method of making abrasive articles including a vacuum metallizing step depositing a strike metal coating on a cured resin coating containing abrasive granules and electro plating a harder metal coating over the strike coating to firmly anchor the granules.

A specific object of the invention is to provide an inexpensive method of making fingernail files wherein vacuum metallizing is utilized to bond a thin electro plate to an abrasive particle carrying resin coating on a metal base.

A further specific object of this invention is to provide an inexpensive method of making abrasive articles having an electro plated coating anchoring abrasive particles on a base wherein the coating is bonded to a cured resin carrying the particles by a vacuum metallizing operation.

Other and further objects of this invention will be apparent to those skilled in this art from the attached drawing and the written description thereof illustrating the best mode embodiment of the invention.

ON THE DRAWINGS

AS SHOWN ON THE DRAWING

Figure 1:
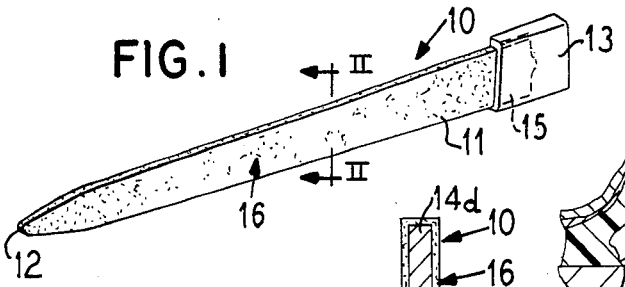
FIG. 1 is a perspective view of a fingernail file made by the method of this invention.
Figure 2:
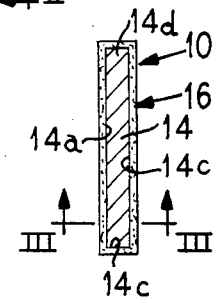
FIG. 2 is an enlarged transverse cross-sectional view along the line II—II of FIG. 1.
Figure 3:
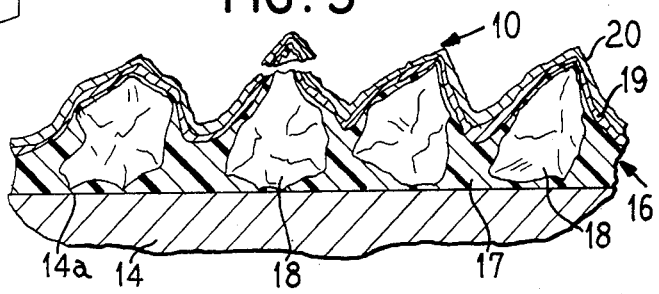
FIG. 3 is a greatly magnified cross-sectional fragmentary view along the line III—III of FIG. 2.

The reference 10 of FIGS. 1 to 3 designates generally a fingernail file of the type made by the method of this invention. The file 10 has an elongated body portion 11 with a bluntly pointed free-end 12 and a plastic cap or head 13 embracing the opposite end. The body 11 is composed of a mild steel finger strip 14 with broad flat opposite faces **14*a* and 14*b* and thin end edges 14*c* and 14*d*. The finger strip diverges from the blunt end 12 and tapers to a wide end 15 which is encased in the plastic head or cap 13. The exposed length of the strip 14 along the wide faces 14*a* and 14*b* and along the end edges 14*c* and 14*d* covered with a multiple layer coating 16 composed of a base layer 17 of resin material with sharp abrasive granules 18, a strike coating of metal 19 surrounding the base layer and an outer layer 20 of electro deposited metal surrounding the layer 19. The granules 18 on one face 14*a* of the strip 14 may be coarser than the granules 18 and the other face 14*b* of the strip. The coating 17 forms a sheath or envelope around the body 11, the strike coating 19 forms a sheath or envelope around the coating 17 and the electro deposited coating 20 forms a sheath or envelope around the strike coating 19. The electro deposited coating 20 is firmly anchored through the strike coating 19 to the resin coating 18**.

As illustrated in FIG. 3, the resin coating 17 settles or shrinks down between the peaks of the abrasive granules 18 and the strike coating 19 covers the resin coating 17 as well as the peaks of the granules 18 to form a metal sheath on which the harder metal coating 20 is electro deposited. The peaks of the granules are only covered with thin caps of the coating which, as illustrated, break off or wear away in use to expose the sharp points of the granules to permit them to function as an abrasive.

The plastic coating 17 is preferably a short chain epoxy ester or epoxide resin soluble in a hydrocarbon solvent capable of skin curing. Suitable epoxides have been furnished by Emerson and Cuming, Inc. of Kenton, Mass. under the tradename "Echo coat", LLN 78122.

The abrasive granules 18 are preferably aluminum oxide but other sharp jagged refractory granules having a good abrading action, such as silicon carbide, nickel oxide, tungsten carbide and the like are useful. The granules vary in size from, about, 120 to 130 mesh. Suitable grit size combinations for coarse and fine sides of fingernail files include 320 on one side and 280 on the other side; 280 on one side, 240 on the other side or 240 on one side and 120 on the other side.

A preferred slurry for forming the coating 17 is:

6 pounds aluminum oxide;

20–24 ounces xylene or methylethylketone;

1 gallon Emerson-Cuming epoxide resin solution LN78122 composed of 80% epoxy resin, 18% melamine, 1% bentone as a stabilizer and 1% pigment such as titanium.

All of the indicated percentages are by weight.

The slurries with formulations such as the above are relatively thin with the resin settling down on the metal base 14 and to maintain the granules or grits in suspension the slurry is agitated as it is applied, preferably by spray coating.

A preferred spray technique is to pass over the blank in each of four right angled directions with a concentration such that one gallon of the formulation will cover about 500 square feet. Following each spray coating, the coated blanks are heated to about 375° F. for about 15 minutes thereby forming a skin cure which is then followed by a final cure at lower temperatures of about 175° for 20–24 hours.

The blanks with the cured coatings thereon are then suspended in the vacuum chamber of a vacuum metallizing apparatus such as the commercial apparatus offered by Penwalt-Stokes Company. The apparatus provides a crucible in the vacuum chamber in which copper or a copper alloy, preferably 93% copper and 7% aluminum, is inserted in powder or wire form. The apparatus is evacuated to degasify the suspended blanks, is then heated to melt the copper, and is next further evacuated to less than the vapor pressure of the copper whereupon the vapor is deposited on the coated blanks to form a strike coating which can be very thin in the nature of 1200 angstroms. The pre-heat at about a 45% setting of the Penwalt-Stokes apparatus is effected for about 30 seconds whereupon the setting is increased to about 85% for another 30 seconds. The vacuum established is in the nature of $5\times10^5$ torr.

Following the vacuum metallizing, the strike coated blanks are etched in sulphuric acid, rinsed, and then nickel plated in standard electro plating apparatus for about 9 minutes thereby applying a hard metal coat or layer over the strike coating. The strike coating anchors the hard metal coating to the resin coating.

The etching is effected by immersing the blanks in a 10% aqueous sulphuric acid bath for about 2 to 3 minutes at 160° F. The rinsing is effected with cold water.

Standard nickel plating techniques are used to produce a coating of about 0.00009 to 0.00012 inches. A suitable nickel bath can be formed with 34 ounces of nickel sulfate, 18 ounces of nickel floride, 8 ounces of boric acid, and 1300 gallons of water.

Figure 4:
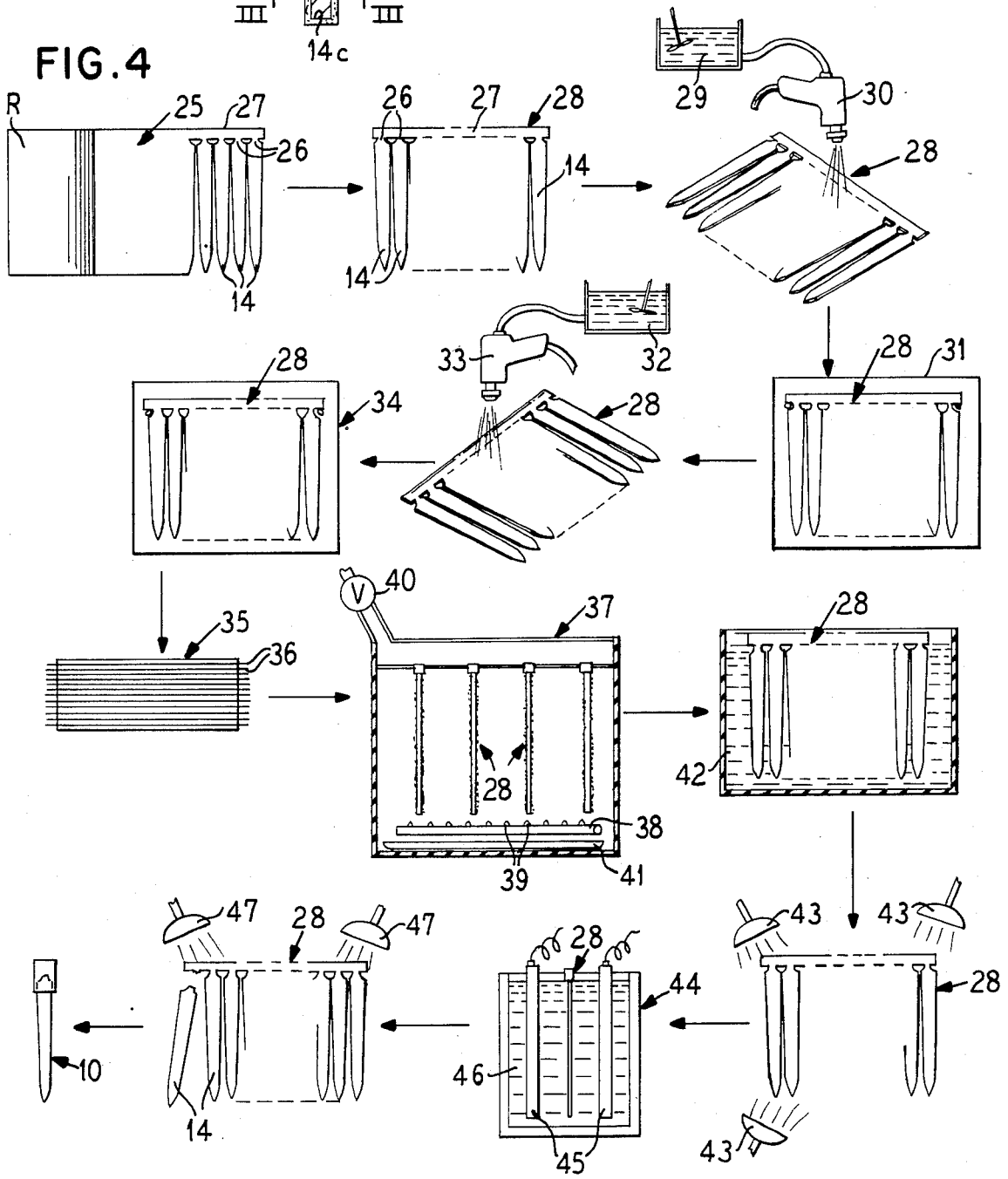
FIG. 4 is a diagrammatic flow sheet illustrating the steps in the method of this invention.

The flow sheet of FIG. 4 illustrates a best mode sequence of operation for producing the nail files 10. As there shown, a strip 25 of mild steel such as SAE 1010 is unreeled from a roll R and its leading end is successively stamped to form the fingers 14 suspended through thin connecting nibs 26 from a header 27. A suitable length of the header 27 is severed from the strip 25 to form a blank 28 where a desired number of fingers 14 depend from a single header 27. Blanks 28 of 40–50 fingers 14, about 5 inches in length, and tapering from about $\frac{3}{8}$ to about $\frac{1}{4}$ inch in width are useful. The strip 25 need only be about 1/32 of an inch thick.

The blanks 28 are laid flat with the top exposed face spray coated with the resin slurry 20 which is continually agitated to maintain the granules in suspension. A spray gun 30 is directed over the top face of the blank 28. The coated blank 28 is then dried in an oven 31 to skin cure the resin on the top face. The skin cured blank is then removed from the oven, laid flat with its uncoated face upward, and the uncoated face is then spray coated with a second slurry 32 through a spray gun 33. Next, the blank is skin cured in an oven 34, repeating the process from the oven 31.

The skin cured blanks are then stacked as illustrated at 35 with paper sheets 36 between the blanks. The stack is heated to about 175° C. for a day or so to final cure the resin.

The blanks 28 with the cured resin coatings are then suspended in the vacuum metallizing apparatus 37 above a refractory crucible 38 filled with the copper powder 39. The apparatus is evacuated as illustrated at 40 and heating coils of 41 in the apparatus are provided to melt the copper. As indicated above, the apparatus is initially evacuated to degasify its content and the heating coils are then energized to melt the copper with the evacuation being increased to vaporize the molten copper and deposit it as a thin strike coating on the blanks.

Following the vacuum metallizing step, the strike coated blanks 28 are submerged in a sulphuric acid etching bath 42 as described above, and are then rinsed with water as from spray heads of 43 or the like.

The rinsed etched blanks 28 are then electro plated as illustrated at 44 to form the nickel coating. As indicated the electro plating includes electrodes 45 along side opposite faces of the blank 28 immersed in the nickel electrolyte bath 46.

Following the nickel plating step, the blanks are rinsed with water from spray heads 47 and the fingers are broken off from the header to provide the finished nail files 10.

While copper or copper alloy is specified as the preferred strike coating metal and while nickel is specified as the preferred electro plated metal, it will be understood that substitute strike coating metals and electro plating metals are also useful. The strike coating metal must have an affinity for the resin coating and the electro plated metal and it has been found that aluminum is inadequate for this purpose. Metals such as tin, zinc, cadmium, nickel, brass and stainless steel are useful substitutes for copper. Metals such as chromium can be substituted for the nickel in the electroplating step or it can be used over the nickel plate. The temperatures of the vacuum metallizing chamber will vary according to the strike metal being used. With copper, temperatures of about 2300° are useful at vapor pressures of $10^{-2}$ torr.

From the above descriptions, it will be understood that this invention provides a simplified method of producing abrasive articles or devices with friction surfaces, such as fingernail files.

Although the invention has been described with respect to preferred embodiments, it is not to be so limited as changes and modifications can be made which are within the full intended scope of the invention as defined by the appended claims.

We claim:

1. The method of making files which comprises stamping sheet metal into a plurality of fingers depending from a header strip, covering the fingers with a slurry of epoxide resin and abrasive grits, heat curing the epoxide resin to form a sheath around each finger with the abrasive grits firmly anchored therein, suspending a plurality of the sheath covered fingers from their header strips in a vacuum chamber, evacuating the chamber to degasify the sheaths on the fingers, melting a strike metal in the chamber, increasing the vacuum in the chamber below the vapor pressure of the molten strike metal, depositing a thin layer of the strike metal around each plastic sheath, acid etching the deposited strike metal layer on each finger, electroplating a hard metal layer around each etched strike metal layer, separating the fingers from the header strips, and applying a plastic handle over the separated ends of the fingers.

2. The method of making articles with friction surfaces which comprises providing a base of desired shape, forming a sheath of plastic material having abrasive grits anchored therein around the base, vacuum metallizing a strike metal layer around the sheath, acid etching the strike metal layer, and electroplating a hard metal coating over the etched strike metal layer.

3. The method of making articles with friction surfaces which comprises providing a metal base of desired shape, coating a slurry of abrasive grits and flowable plastics material on said base, setting the plastics material to anchor the grits on the base, suspending the set plastics material coated base in a vacuum chamber, evacuating the chamber to degasify the coating, melting copper in the chamber, increasing the vacuum in the chamber below the vapor pressure of the molten copper, depositing a thin coating of copper on the set plastics material, etching the copper layer with sulphuric acid, and electroplating a thin layer of nickel on the etched copper layer whereby the nickel is firmly anchored through the copper to the plastics material and forms a metal coating firmly securing the grits.

4. The method of claim 1 wherein the strike metal is copper and the electroplated metal is nickel.

5. The method of claim 4 including the additional step of electroplating a layer of chromium around the nickel plated layer.

6. The method of claim 2 wherein the vacuum metallizing is effected at about 2300° F. at a vapor pressure of about $10^{-2}$ torr.

7. The method of claim 2 wherein the acid etching is effected by immersing the article in a 10% aqueous sulphuric acid bath for about 2 to 3 minutes at 160°.

8. The method of claim 3 wherein the nickel plating produces a coating of 0.00009 to 0.00012" in thickness.

* * * * *